US006189592B1

(12) United States Patent
Domel

(10) Patent No.: US 6,189,592 B1
(45) **Date of Patent: *Feb. 20, 2001**

(54) ROLL UP SHADE DOUBLED FABRIC HAVING PATTERNS THEREON

(75) Inventor: Douglas R. Domel, Santa Clarita, CA (US)

(73) Assignee: Harmonic Design, Inc., Chatsworth, CA (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/420,299

(22) Filed: Oct. 18, 1999

Related U.S. Application Data

(63) Continuation-in-part of application No. 09/044,594, filed on Mar. 19, 1998, now abandoned.

(51) Int. Cl.[7] ..... A47H 1/00
(52) U.S. Cl. ..... 160/85; 160/241
(58) Field of Search ..... 160/85, 86, 121.1, 160/122, 241

(56) References Cited

U.S. PATENT DOCUMENTS

| | | | | |
|---|---|---|---|---|
| 550,512 | * | 11/1895 | Lane | 160/121.1 |
| 2,140,049 | | 12/1938 | Grauel | 156/10 |
| 2,142,822 | * | 1/1939 | Moore | 160/120 |
| 2,280,358 | * | 4/1942 | Tietig | 160/121.1 X |
| 2,281,022 | * | 4/1942 | Cavanaugh | 160/85 |
| 2,349,368 | * | 5/1944 | Myers | 160/85 X |
| 2,384,377 | * | 9/1945 | Holstein | 160/85 |
| 2,581,433 | * | 1/1952 | North et al. | 160/120 |
| 2,702,081 | * | 2/1955 | North et al. | 160/120 |
| 2,865,446 | | 12/1958 | Cole | 160/85 |
| 2,970,643 | * | 2/1961 | Adamsky | 160/121.1 |
| 3,444,919 | * | 5/1969 | Karoll | 160/237 X |
| 3,701,376 | * | 10/1972 | Froget | 160/121.1 |
| 3,789,904 | * | 2/1974 | Takazawa | 160/120 |
| 3,980,122 | * | 9/1976 | Takazawa | 160/85 |
| 4,273,099 | * | 6/1981 | Morgan | 160/86 |
| 4,368,771 | * | 1/1983 | Hopper | 160/121.1 |
| 4,433,712 | * | 2/1984 | Mellon et al. | 160/122 |
| 4,766,941 | * | 8/1988 | Sloop et al. | 160/241 |
| 5,168,647 | * | 12/1992 | Castro | 160/85 |
| 5,538,065 | * | 7/1996 | Geraud | 160/85 |
| 5,566,736 | * | 10/1996 | Crider et al. | 160/85 |
| 5,664,613 | * | 9/1997 | Jelic | 160/121.1 X |

FOREIGN PATENT DOCUMENTS

| | | | |
|---|---|---|---|
| 1 173 935 | 9/1984 | (CA) | 341/31 |
| 95100941 | 1/1995 | (DE) . | |
| WO 90/03060 | 3/1990 | (WO) | H02J/13/00 |

OTHER PUBLICATIONS

Brochure: Becker Tubular Motors. 10 pp. Germany.
Brochure: YKK. 5 pp. No. 81488 5. Japan.

* cited by examiner

*Primary Examiner*—Blair M. Johnson
(74) *Attorney, Agent, or Firm*—John L. Rogitz

(57) ABSTRACT

A roll-up shade is doubled and its ends suspended from a head rail that is mounted above a window. One end is attached to a roller tube and the other end is attached to a stationary tube, with a bight being formed between the tubes. A first sheet is defined from the bight to the roller tube and a second sheet is defined from the bight to the stationary tube. A weighty rod is positioned in the bight to cause the bight to sag away from the head rail, and a shade guide surrounds the rod to guide the shade. With this structure, the roller tube can be rotated to pull up the first sheet and raise the bight or to lower the first sheet with bight, with the second sheet (i.e., the sheet that is directly attached to the stationary tube) remaining unmoving above the bight. The shade is patterned such that when the shade is raised and lowered, the relative motion between the two sheets causes the shade to alternatingly assume high and low opacity configurations. The roller tube can be motorized if desired.

17 Claims, 3 Drawing Sheets

ROLL UP SHADE DOUBLED FABRIC HAVING PATTERNS THEREON

RELATED APPLICATIONS

This application is a continuation-in-part of and claims priority from U.S. patent application Ser. No. 09/044,594, abandoned, filed Mar. 19, 1998, incorporated herein by reference.

FIELD OF THE INVENTION

The present invention relates generally to window coverings, and more particularly to powered and manual shades.

BACKGROUND

Roll-up shades are popular window coverings in which a flexible fabric or other material is suspended from a roller tube. In many instances, the roller tube is enclosed in a head rail that is mounted above the window to be covered. The roller tube can be rotated to raise and lower the shade. Thus, in conventional shades, the shade must be raised or lower to change the amount of light passing through the window, and the amount of light passing through the shade itself (per unit area) cannot be altered.

Because it is sometimes desirable to alter the amount of light per unit area passing through a window covering, i.e., to alter the opacity of a window covering in addition to raising and lowering the window covering, devices have been introduced which permit altering both the opacity of the window covering and which also permit raising and lowering the covering. Representative of these devices are horizontal mini-blinds, in which louvered slats of a blind can be moved between raised and lowered positions and also can be rotated in concert with each other between open and closed configurations. Rotating the slats alters the amount of light passing through the blind.

Similarly, Hunter-Douglas has introduced a roll-up shade device marketed under the name "Silhouette", in which horizontal strips of fabric are suspended between two sheets of fabric. The strips can be rotated only when the shade is in the fully lowered position to alter the opacity of the shade. Specifically, a mechanism can be operated to lower the shade completely, and then continued operation of the mechanism causes the strips to turn to the closed configuration. To open the strips, the mechanism is operated to raise the shade, which initially causes the strips to rotate to the open configuration. Continued operation of the mechanism raises the roll-up shade.

As recognized by the present invention, both mini-blinds and roll-up shades have certain drawbacks. With respect to mini-blinds, two mechanisms are necessary, one for raising/lowering the shade and one for opening/closing the slats. This increases the relative cost and complexity of mini-blinds. Moreover, the amount of light passing through the slats cannot easily be altered as the blind is being raised or lowered, because the slats can become fouled. Furthermore, the slats stack up against the bottom rail as they are raised, further complicating the ability to rotate the louvered slats between open and closed configurations when the blind is between the fully raised and fully lowered positions.

With respect to Silhouette™-type roll-up shades, on the other hand, the strips cannot be rotated at all unless the shade is fully lowered. In shade positions above fully lowered, the amount of light passing through the shade per unit area simply cannot be altered. Thus, as a Silhouette™-type roll-up shade is raised or lowered, and when the shade is in any position above the lowered position, the amount of light per unit area passing through the shade itself (i.e., its opacity) cannot be altered. Moreover, because the opacity of the Silhouette™-type roll-up shade cannot be altered unless the shade is fully lowered, the length of the shade must be precisely measured to fit more or less exactly within the structure of the window sought to be covered, and if the length is even slightly longer or shorter than required for the particular window, the shade will not operate. Consequently, Silhouette™-type roll-up shades are frequently mis-sized for the windows sought to be covered, and as a result have a relatively high return rate to the vendor.

As recognized by the present invention, however, it is desirable and possible that a window covering alter its opacity as the window covering is being raised or lowered, for pleasing, aesthetic effects. The present invention also recognizes that it is desirable and possible to facilitate altering the opacity of a shade-type window covering when the covering is in any position between fully raised and fully lowered, as might be desired by a user.

Accordingly, it is an object of the present invention to provide a window covering that alters its opacity when being raised and lowered. Another object of the present invention is to provide a shade-type window covering in which the opacity can be altered when the shade-type window covering is between the fully raised position and the fully lowered position. Still another object of the present invention is to provide a window covering which presents an aesthetically pleasing appearance when being raised or lowered. Yet another object of the present invention is to provide a window covering that is easy to use and cost effective to manufacture.

SUMMARY OF THE INVENTION

A window covering includes a roller tube, a stationary holder next to the roller tube, and a shade having opposed first and second ends. The first end is engaged with the roller tube and the second end is engaged with the stationary holder such that the shade forms a looped bight between its ends, the bight essentially establishing the bottom of the shade. A lift mechanism is coupled to the roller tube to selectively rotate the roller tube and thereby move the shade between a raised position, wherein the bight is closely juxtaposed with the stationary holder, and a lowered position, wherein the bight is distanced from the stationary holder.

Preferably, the shade defines a pattern, and because of the cooperation of the pattern on the juxtaposed sheets of the shade, as the shade is raised and lowered, the shade moves between low and high opacity configurations. In a particularly preferred embodiment, the shade is established by alternating first and second strips, with the first strips being characterized by relatively high opacity and the second strips being characterized by relatively low opacity. Or, the first strips can be characterized by a first pattern and the second strips can be characterized by a second pattern. The first pattern is different from the second pattern, and this difference can be attributable to the pattern of the first strips being staggered from the pattern of the second strips.

As disclosed in further detail below, a rod is disposed in the bight. Also, the lift mechanism can be manually operated, or the lift mechanism can include a motor and at least one battery.

In another aspect, a window covering includes a suspension assembly that in turn includes first and second holders.

A shade defines a first sheet and the first sheet is suspended from the first holder. In accordance with the present invention, the first sheet terminates at a bight. The shade also defines a second sheet and the second sheet is suspended from the second holder. Like the first sheet, the second sheet terminates at the bight. At least the first holder is operable to raise the first sheet while the second sheet remains stationary.

In still another aspect, a window covering includes a double sheet shade suspended from first and second holders, and at least the first holder is operable to raise and lower the shade such that the sheets of the shade move relative to each other.

An alternate window covering includes a roller tube, a holder, and a shade having opposed first and second ends. The first end is engaged with the roller tube and the second end is engaged with the holder such that the shade forms a bight between its ends. A rod is disposed in the bight and a shade guide surrounds the rod and shade to guide the shade around the bight. A lift mechanism is coupled to the roller tube to selectively rotate the roller tube and thereby move the shade between a raised position, wherein the bight is closely juxtaposed with the holder, and a lowered position, wherein the bight is distanced from the holder.

The details of the present invention, both as to its structure and operation, can best be understood in reference to the accompanying drawings, in which like reference numerals refer to like parts, and in which:

DETAILED DESCRIPTION OF THE PREFERRED EMBODIMENT

Figure 1:
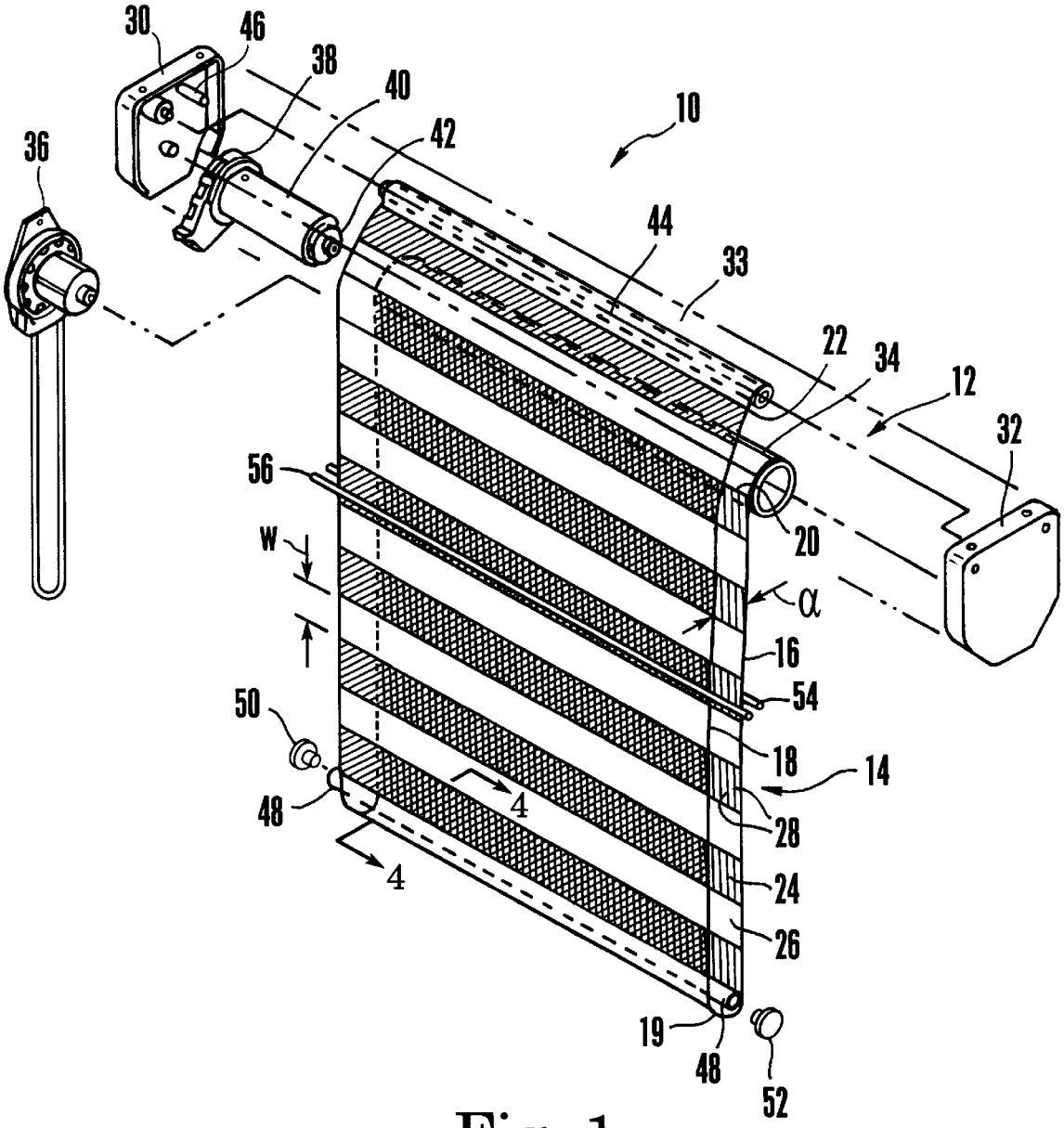
FIG. 1 is an exploded perspective view of the present window covering in the fully lowered position and low opacity configuration, with portions of the head rail shown in phantom.

Referring initially to FIG. 1, a window covering is shown, generally designated 10, which includes a suspension assembly, generally designated 12, from which is suspended a flexible shade, generally designated 14. As shown in FIG. 1, the shade 14 defines first and second coparallel planar sheets 16, 18 that face each other, with a U-shaped bight 19 being established between the sheets 16, 18. The bight 19 is the lower-most part of the shade 14. As intended by the present invention, the sheets 16, 18 are contiguous to each other, with the boundary between the sheet 16, 18 essentially being established by the bight 19.

Also, each sheet 16, 18 defines a respective top end 20, 22 that is engaged with the suspension assembly 12. As described in detail below, the suspension assembly 12 is operable to raise and lower the shade 14, and when the shade is being raised or lowered, the sheets 16, 18 of the shade 14 move relative to each other. More particularly, the first sheet 16 is translationally moved upwardly while the second sheet 18 (i.e., the portion of the shade 14 between the top end 22 and the bight 19) remains translationally stationary, as the shade 14 is raised. Likewise, the first sheet 16 is translationally moved downwardly while the second sheet 18 (i.e., the portion of the shade 14 between the top end 22 and the bight 19) remains translationally stationary, as the shade 14 is lowered. As the present invention recognizes, however, as the shade 14 is raised and lowered, the bight 19 is correspondingly raised and lowered and, consequently, the area of the first sheet 16 correspondingly grows smaller and larger.

The above-described relative motion between the sheets 16, 18 results in altering the opacity of the shade 14 in a pleasing and useful manner. Specifically, the shade 14 defines a pattern as shown in FIG. 1, and owing to the pattern, as the shade 14 is raised and lowered the shade moves between a low opacity configuration, shown in FIG. 1, in which a relatively large amount of light per unit area can pass through the shade 14, and a high opacity configuration, shown in FIG. 2, in which a relatively small amount of light per unit area can pass through the shade 14.

More specifically, in the preferred embodiment the shade 14 is established by alternating first and second strips 24, 26, each having a width "W". In the embodiment shown, the first strips 24 are of the same width "W" as the second strips 26, although it is to be understood that in other embodiments the first strips can have widths "W" that are different from the widths of the second strips and indeed that are different from each other. Advantageously, the shade 14 can be a single piece of fabric that is commercially available in the patterns disclosed herein.

In one intended embodiment, dark, opaque diagonal lines 28 are printed, deposited, or otherwise formed on the first strips 24, such that the first strips 24 are characterized by relatively high opacity. In contrast, the second strips 26 are characterized by relatively low opacity, and in one intended embodiment the second strips are made of colored translucent material or indeed clear transparent material. To increase the opacity of the shade when it is in the high opacity configuration, the first (i.e., relatively opaque) strips 24 have widths "W" that are greater than the widths "W" of the second (i.e., less opaque) strips 26.

Figure 2:
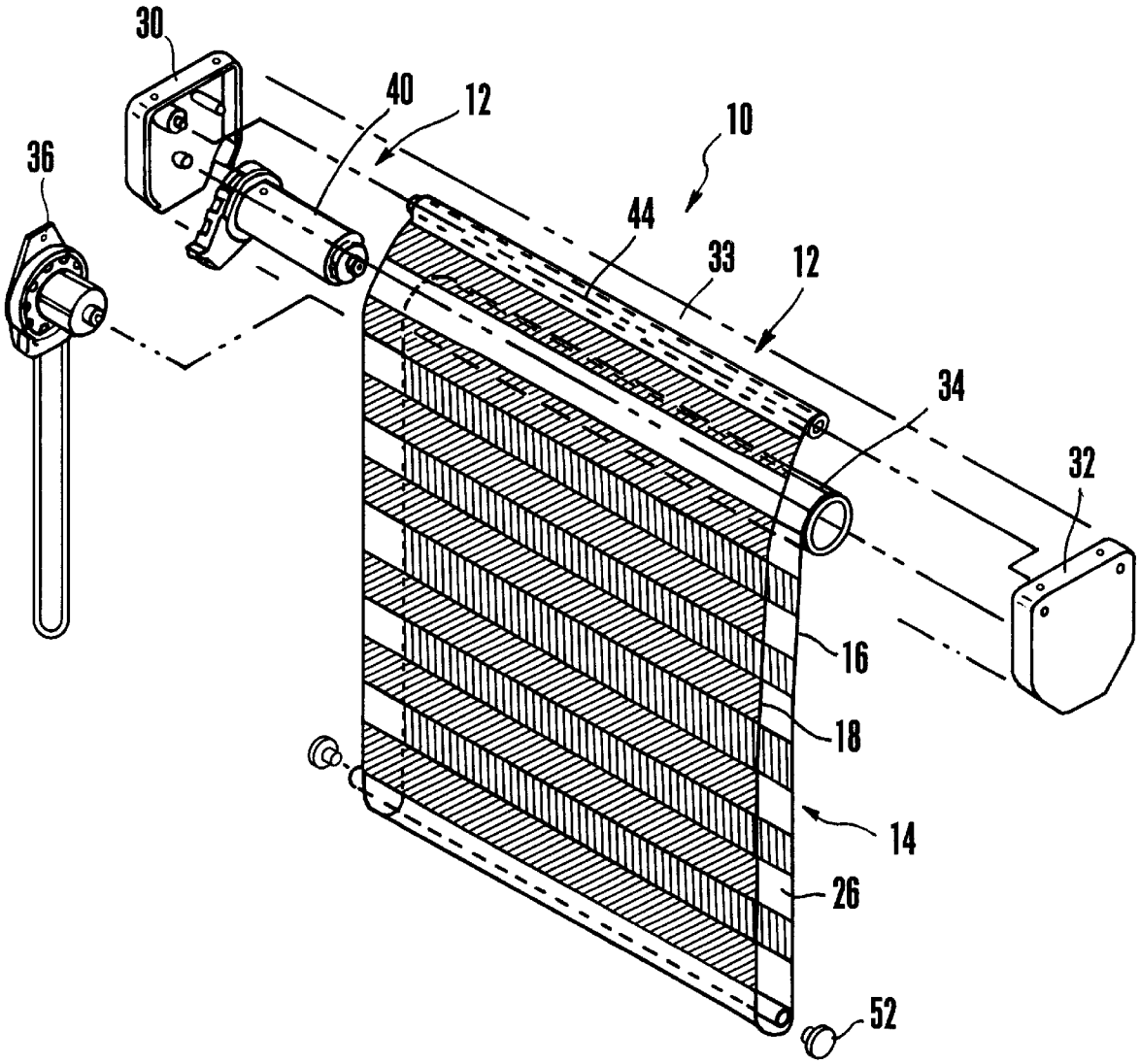
FIG. 2 is an exploded perspective view of the present window covering between the fully lowered and fully raised positions, in a high opacity configuration, with portions of the head rail shown in phantom and with the spacing bars or rollers removed for clarity.

With the above disclosure in mind and in cross-reference to FIGS. 1 and 2, it may now be appreciated that as the shade 14 is raised and lowered, the strips 24, 26 of the second sheet 18 are respectively moved upwardly and downwardly, whereas the strips 24, 26 of the first sheet 16 are substantially stationary. Thus, the strips 24, 26 of the second sheet 18 move past the strips 24, 26 of the first sheet 16.

When the second strips 26 of the first sheet 16 are juxtaposed with the second strips 26 of the second sheet 18 (FIG. 1), the shade 14 is in the low opacity configuration, because light can easily pass through the juxtaposed second strips 26. On the other hand, when the first strips 24 of one of the sheets 16, 18 are juxtaposed with the second strips 26 of the other sheet 18, 16 (FIG. 2), it can readily be appreciated that the first strips 24 interfere with the passage of light substantially throughout the shade 14, thereby configuring the shade 14 to have relatively high opacity.

Accordingly, the shade 14 can be easily and rapidly moved between the low and high opacity configurations simply by raising or lowering the shade 14 by an amount equal to the width "W" of each strip 24, 26, regardless of the height of the shade 14. Moreover, the opacity of the shade 14 constantly waxes and wanes in an interesting and aesthetically pleasing way as the shade 14 is moved between a raised position, wherein the bight 19 is closely juxtaposed with the suspension assembly 12 and the shade 14 is substantially rolled up, and a lowered position shown in FIG. 1, wherein the bight 19 is distanced from the assembly 12 and the shade 14 is substantially unrolled.

In understanding how the suspension assembly 12 moves the shade 14 as described above, reference is made to FIG. 1. The preferred suspension assembly includes left and right end caps 30, 32 that are attached to, e.g., a window frame at or near the top of the window. Preferably, a hollow head rail 33 extends between the end caps 30, 32 and encloses part or all of the suspension assembly 12.

A movable holder, preferably a roller tube 34, is rotatably engaged with at least one of the end caps 30, 32 at one end of the roller tube 34 and, at the other end of the roller tube 34, the tube 34 is engaged with a lift mechanism. As shown in FIG. 1, the end 20 of the first sheet 16 is attached to the roller tube 34 by adhesive bonding or by mechanical fasteners such as staples. It is to be understood that in the raised position, the shade 14 is substantially rolled up onto the roller tube 34.

The lift mechanism of the present invention can be a manually operated device such as a conventional clutch mechanism 36 that is engaged in accordance with conventional principles with the roller tube 34 to rotate the tube 34 and thereby lift or lower the first sheet 16 and bight 19. Or, the lift mechanism can be an electrically powered mechanism that rotates the roller tube 34 to thereby lift or lower the first sheet 16 and bight 19.

In one embodiment, the lift mechanism includes a dc motor 38 that is selectively energized by one or more dc alkaline or lithium primary batteries 40. The motor 38 is gearedly coupled to a collar 42, and the collar 42 fits snugly within a complementarily configured channel of the roller tube 34 in stationary engagement therewith, such that when the motor is energized the roller tube is rotated. In the preferred embodiment, the structure and cooperation of the motor 38, batteries 40, and collar 42 are fully set forth in co-pending U.S. patent application Ser. No. 08/923,812, filed Sep. 4, 1997 for an invention entitled "Head Rail Mounted Actuator for Window Coverings", which claims priority from U.S. Pat. No. 5,698,958, both of which are fully incorporated herein by reference.

As seen in FIG. 1, the end 22 of the second sheet 18 is fastened to a stationary holder, such as a wall surface or part of the head rail. Part of the second sheet 18 can indeed be used as a valance. Preferably, however, the second holder is a mounting tube 44 that is received on respective left and right support pins 46 (only the left pin 46 shown in FIG. 1) on the respective end caps 30, 32. The mounting tube 44 can be received on the pins 46 in an interference fit that is sufficiently tight to prevent the tube 48 from rotating during normal operation, while allowing a person to manually rotate the tube 48 to establish the length of the shade 10 in the fully lowered position as appropriate for the particular window sought to be covered. Thus, by "stationary" holder is meant a holder that does not move during normal operation of the shade 10. In any case, it can readily be appreciated that with the end 20 of the first sheet 16 engaged with the roller tube 34, and the end 22 of the second sheet 18 engaged with the mounting tube 44 or other stationary holder, the shade 14 hangs downwardly from the head rail 33 to form the bight 19 between the ends 20, 22 of the shade 14.

To weight the shade, a solid or hollow cylindrical metal or plastic rod 48 is disposed in the bight 19. As the shade 14 is moved between the raised and lowered positions, the rod 48 rolls on the shade 14 within the bight 19.

To retain the rod 48 in the bight 19, left and right rod ends caps 50, 52 are positioned in the ends of the rod 48 and/or guide 49. Alternatively, the rod 48 can be suspended from the head rail 33 by suspension lines (not shown), the length of which is about equal to the distance from the head rail 33 to the bight 19 when the shade 14 is in the lowered position. Moreover, if desired the ends of the rod 48 can be slidably engaged with channels (not shown) that are established by structure in the sill of the window, to hold the shade 10 relatively stationary when, e.g., wind blows the against the shade 10.

If desired, to hold the sheets 16, 18 close together when the shade is lower than about midway between the raised and lowered positions, and thereby augment the above-noted effects as the shade 10 is raised and lowered, two parallel spacing bars or rollers 54, 56 can be affixed to the rod 48 at the respective ends of the bars or rollers 54 and rod 48. As shown, the sheets 16, 18 extend between the bars or rollers 54, 56. The distance between the spacing bars or rollers 54, 56 is established to in turn establish the distance 67 between the sheets 16, 18. It will readily be appreciated that the bars or rollers 54, 56 hold the shades 16, 18 close together, while allowing for the rod 48 to pass between the bars or rollers 54, 56.

Figure 3:
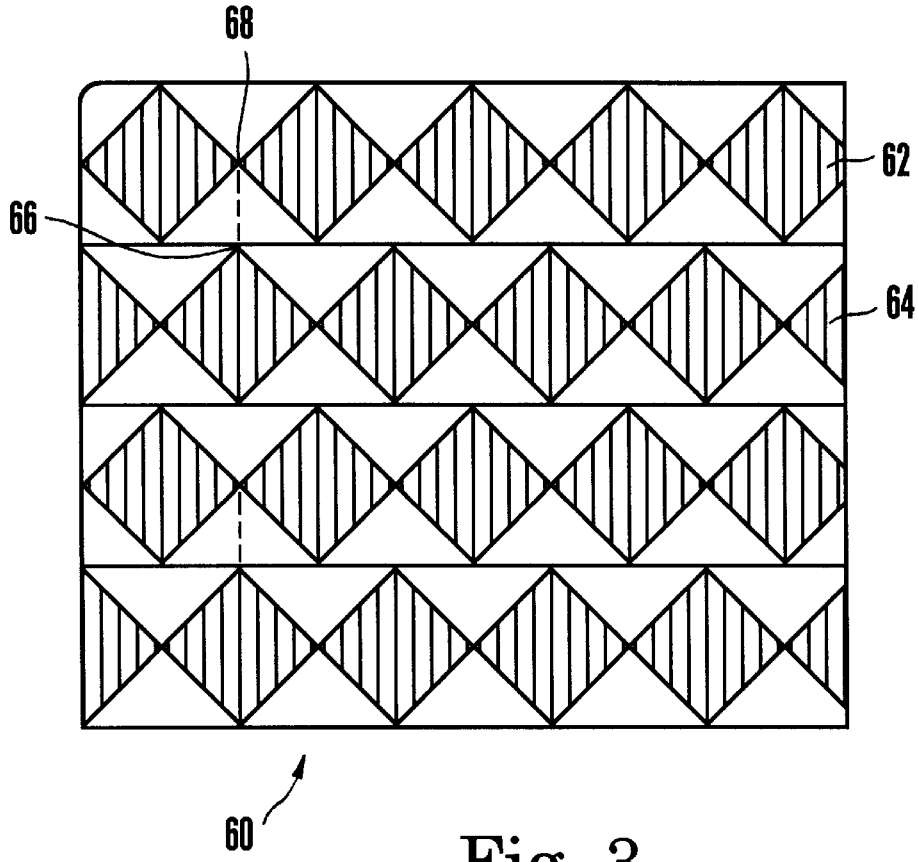
FIG. 3 is a plan view of a shade showing an alternate pattern.

In accordance with present principles, the shade of the present invention can have patterns other than the one shown in FIGS. 1 and 2. For example, FIG. 3 shows but one such alternative shade, generally designated 60, which includes alternating first and second strips 62, 64, The first strips 62 have a row of diamonds thereon, and the second strips 64 likewise have a row of diamonds thereon, with the top vertices 66 of the diamonds in the second strips 64 being vertically aligned with the junctions 68 of the left and right vertices of adjacent diamonds in the first strips 62. Thus, the first strips 62 are characterized by a first pattern and the second strips 64 are characterized by a second pattern that is staggered relative to the first pattern. As yet another alternative, to provide for almost complete opacity when the shade of the present invention is in the opaque configuration, the present shade can be characterized by a checkerboard pattern.

While the above discussion discloses a movable holder that is a roller tube which functions by rolling the shade, it is to be understood that the holder alternatively can function by, e.g., raising the shade to configure the shade in accordion-type pleats. Also, while the above discussion focusses on a stationary holder, it is to be understood that both holders can be rotatable or otherwise movable relative to each other, as long as relative motion between the sheets 16, 18 of the shade 14 is effected.

Figure 4:
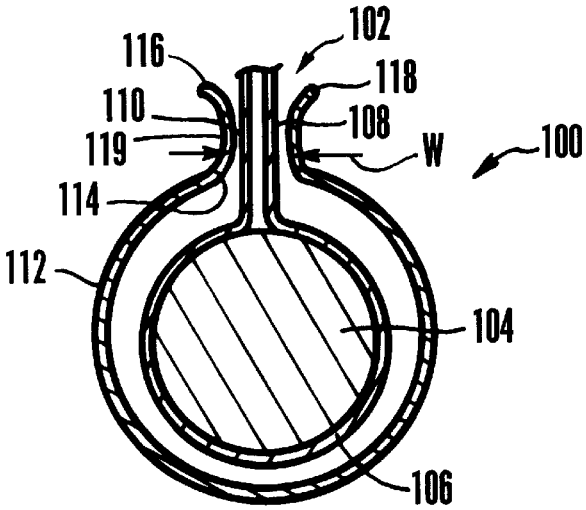
FIG. 4 is a cross-sectional view of an alternate embodiment showing the guide tube, as would be seen along the line 4—4 in FIG. 1.

FIG. 4 shows an alternate window covering 100 that is in all essential respects identical to the covering 10 shown in FIGS. 1–3, with the following added feature. To guide a patterned shade 102 of the window covering 100 around a lower rod 104 in a bight 106 formed by sheets 108, 110 of the shade 102, and to keep the sheets 108, 110 closely juxtaposed as the shade is raised and lowered, thereby enhancing the effect of the moving shade pattern, a hollow shade guide 112 surrounds the rod 104 and the portion of the shade 102 that is engaged therewith. As shown, the shade guide 112 is generally tubular in shape and preferably extends the length of the rod 104. The preferred shade guide 112 forms an almost complete circle in transverse cross-section, with the almost complete circle being interrupted only by an open slit 114 extending the length of the shade guide 112. The slit 114 terminates along its long edges in opposed gently curved guide arms 116, 118, between which the sheets 108, 110 extend.

It is to be understood that the width "w" of the slit 114 is marginally larger than the combined thickness of the sheets 108, 110. Looked at another way, the arms 116, 118 extend upwardly from respective locations on the tubular portion of the guide 112 the distance between which is less than the diameter of the guide 112.

Figure 5:
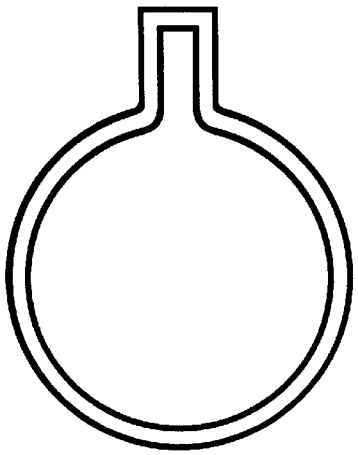
FIG. 5 is an end view of an end cap that can be used with the embodiment of the window covering shown in FIG. 4.

In one preferred embodiment, the shade guide 112 is made of a unitary piece of extruded acrylic, although other plastics can be used. The shade guide 112 is slid onto the rod 104 to dispose the guide 112 in the configuration shown. End caps 120 (only a single end cap 120 shown in FIG. 5) can be closely engaged with the ends of the guide 112 to retain the rod 104 and sheet 102, with the end caps 120 being in all essential respects identical to the end caps 50, 52 described above with the exception that the end caps 120 have teardrop shapes, to match the shape of the guide 112.

While the particular ROLL UP SHADE WITH DOUBLED FABRIC HAVING PATTERNS THEREON as herein shown and described in detail is fully capable of attaining the above-described objects of the invention, it is to be understood that it is the presently preferred embodiment of the present invention and is thus representative of the subject matter which is broadly contemplated by the present invention, that the scope of the present invention fully encompasses other embodiments which may become obvious to those skilled in the arts and that the scope of the present invention is accordingly to be limited by nothing other than the appended claims, in which reference to an element in the singular is not intended to mean "one and only one" unless explicitly so stated, but rather "one or more".

What is claimed is:

1. A window covering, comprising:

a roller tube;

a holder;

a shade having opposed first and second ends, the first end being engaged with the roller tube and the second end being engaged with the holder such that the shade forms a bight between its ends;

a rod disposed in the bight;

a hollow shade guide forming a channel, the channel being open along a slit, the rod being parallel with the guide and being advanceable through the slit and disposed in the channel; and a lift mechanism coupled to the roller tube to selectively rotate the roller tube and thereby move the shade between a raised position, wherein the bight is closely juxtaposed with the holder, and a lowered position, wherein the bight is distanced from the holder.

2. The window covering of claim 1, wherein the shade defines a pattern whereby as the shade is raised and lowered, the shade moves between low and high opacity configurations.

3. The window covering of claim 2, wherein the shade is established by alternating first and second strips, the first strips being characterized by relatively high opacity and the second strips being characterized by relatively low opacity.

4. The window covering of claim 2, wherein the shade is established by alternating first and second strips, the first strips being characterized by a first pattern and the second strips being characterized by a second pattern, the first pattern being different from the second pattern.

5. The window covering of claim 2, wherein the shade is established by alternating first and second strips, the first strips being characterized by a first pattern and the second strips being characterized by a second pattern, the first pattern being staggered relative to the second pattern.

6. The window covering of claim 1, wherein the lift mechanism includes a motor and at least one battery.

7. The window covering of claim 6, wherein the lift mechanism is mounted in the head rail.

8. The window covering of claim 1, wherein the lift mechanism is manually operated.

9. A window covering, comprising:

a suspension assembly including a first holder and a second holder;

a shade defining a first sheet suspended from the first holder, the first sheet terminating at a bight, the shade also defining a second sheet suspended from the second holder, the second sheet terminating at the bight, at least the first holder being operable to move the first sheet while the second sheet remains stationary;

a rod in the bight; and a shade guide forming a channel along the entire length of the rod, the rod being disposed in the channel within the shade guide.

10. The window covering of claim 9, wherein the first holder is a roller tube and the second holder is a stationary holder, the window covering including:

a lift mechanism coupled to the roller tube to selectively rotate the roller tube and thereby move the shade between a raised position, wherein the bight is closely juxtaposed with the stationary holder, and a lowered position, wherein the bight is distanced from the stationary holder.

11. The window covering of claim 9, wherein the first sheet moves past the second sheet when the shade is raised and lowered to cause the shade to move between a higher opacity configuration and a lower opacity configuration.

12. The window covering of claim 11, wherein the shade is established by alternating first and second strips, the first strips being characterized by relatively high opacity and the second strips being characterized by relatively low opacity.

13. The window covering of claim 11, wherein the shade is established by alternating first and second strips, the first strips being characterized by a first pattern and the second strips being characterized by a second pattern, the first pattern being different from the second pattern.

14. The window covering of claim 13, wherein the shade is established by alternating first and second strips, the first strips being characterized by a first pattern and the second strips being characterized by a second pattern, the first pattern being staggered relative to the second pattern.

15. The window covering of claim 10, wherein the lift mechanism includes a motor and at least one battery.

16. The window covering of claim 15, wherein the lift mechanism is mounted in the head rail.

17. The window covering of claim 10, wherein the lift mechanism is manually operated.

* * * * *